US005438769A

United States Patent [19]

Mazzarolo

[11] Patent Number: 5,438,769

[45] Date of Patent: Aug. 8, 1995

[54] ANKLE SUPPORTING DEVICE, PARTICULARLY FOR MOTORCYCLING BOOTS

[75] Inventor: Giovanni Mazzarolo, Coste di Maser, Italy

[73] Assignee: Alpine Stars S.p.A., Coste di Maser, Italy

[21] Appl. No.: 32,586

[22] Filed: Mar. 17, 1993

[30] Foreign Application Priority Data

Mar. 20, 1992 [IT] Italy ..... TV92U0016

[51] Int. Cl.[6] ..... A43B 5/00

[52] U.S. Cl. ..... 36/131; 36/89; 36/69

[58] Field of Search ..... 36/89, 131, 68, 69, 36/55, 88, 91, 92, 107, 109, 114, 71, 70 R, 72 B

[56] References Cited

U.S. PATENT DOCUMENTS

| | | | |
|---|---|---|---|
| 398,892 | 3/1889 | Golden | 36/89 |
| 487,492 | 12/1892 | Pugsley | 36/89 |
| 730,366 | 6/1903 | Gunthorp | 36/89 |
| 757,816 | 4/1904 | Krieger | 36/89 |
| 990,567 | 4/1911 | Krieger | 36/89 |
| 1,637,897 | 8/1927 | Eddins | 36/69 |
| 2,156,086 | 4/1939 | Hack et al. | 36/68 |
| 2,165,879 | 7/1939 | Wilkinson | 36/89 |
| 2,261,453 | 11/1941 | Reinhart et al. | 36/89 |
| 2,942,359 | 6/1960 | Bushway et al. | 36/89 |
| 4,882,858 | 11/1989 | Signori | 36/131 |
| 5,056,509 | 10/1991 | Swearington | 36/89 |

FOREIGN PATENT DOCUMENTS

| | | | |
|---|---|---|---|
| 314901 | 10/1919 | Germany | 36/89 |
| 876299 | 3/1953 | Germany | 36/89 |
| 57687 | 3/1937 | Norway | 36/89 |
| 333156 | 10/1958 | Switzerland | 36/86 |

*Primary Examiner*—Paul T. Sewell
*Assistant Examiner*—Thomas P. Hilliard
*Attorney, Agent, or Firm*—Guido Modiano; Albert Josif

[57] ABSTRACT

Supporting device, particularly usable for motorcycling boots including a semirigid body which is formed monolithically and can be associated with the boot upper. The body is provided with a band which surrounds the lateral and rear regions of the foot. The body also has a pair of wings which embrace the malleolar region. A device is thus obtained which has optimum support characteristics for the upper and protective characteristics for the ankle region of the user.

8 Claims, 1 Drawing Sheet

ANKLE SUPPORTING DEVICE, PARTICULARLY FOR MOTORCYCLING BOOTS

BACKGROUND OF THE INVENTION

The present invention relates to a supporting device particularly usable for motorcycling boots.

Motorcycling boots currently usually comprise a sole onto which an upper is stitched; bands of semirigid plastic material can be externally associated with the upper, preferably at the tibia and calf regions; these bands have the particular purpose of avoiding direct injuries to the leg of the motorcyclist due to accidental impacts caused for example by stones or blunt objects which protrude from the ground.

It is also known to arrange some of these bands or plates inside the upper, but these bands or plates are constituted by individual elements which affect individual and clearly defined parts of the foot.

A problem observed in known boots essentially consists of the fact that since the upper extends considerably in a vertical direction, as it has to protect the tibia approximately up to the knee, wear produces a loss of rigidity of the upper part of the upper, with a consequent deformation at the ankle region.

The ankle region is thus no longer supported in an optimum manner, and this can cause sprains for the motorcyclist.

The use of the individual bands or plates described above merely protects against impacts but is ineffective as regards solving the problem of the loss of rigidity of the boot.

SUMMARY OF THE INVENTION

An aim of the present invention is therefore to eliminate the drawbacks described above in known types, providing a device which allows to use a boot which allows the motorcyclist to always have his ankle supported in an optimum manner even when the boot tends to deform due to use.

Within the scope of the above aim, an important object is to provide a device which allows to protect the ankle against accidental impacts, is reliable and safe in use, and has modest manufacturing costs.

This aim, this object and others which will become apparent hereinafter are achieved by a supporting device, particularly for motorcycling boots, characterized in that it is constituted by a semirigid body which is formed monolithically and can be associated with the upper, said body being provided with a band which surrounds the lateral and rear regions of the foot and with a pair of wings which surround the region of the malleoli.

BRIEF DESCRIPTION OF THE DRAWINGS

Further characteristics and advantages of the invention will become apparent from the following detailed description of a particular preferred embodiment, illustrated in the accompanying drawings, wherein.

DESCRIPTION OF THE PREFERRED EMBODIMENTS

Figure 1:
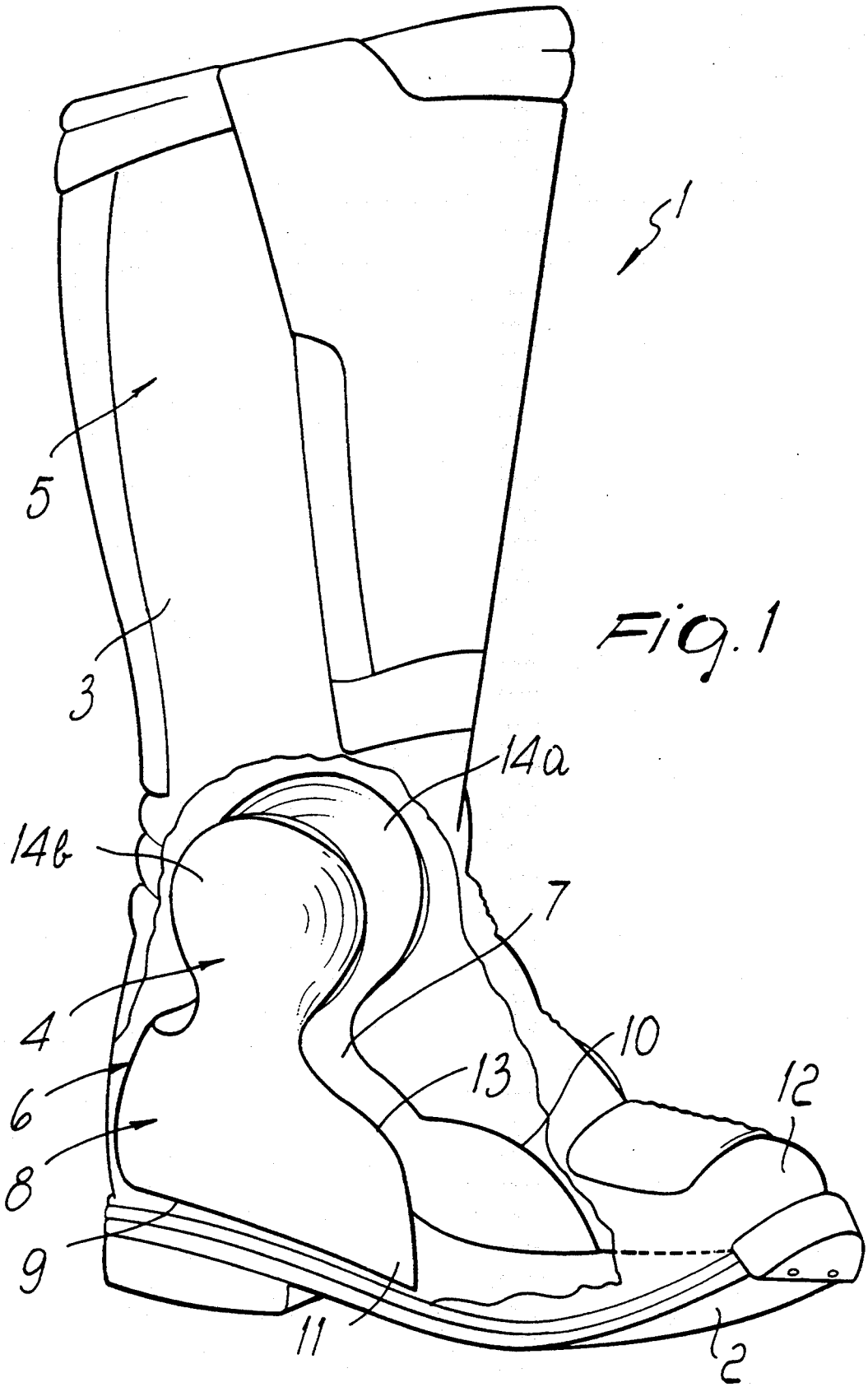
FIG. 1 is a perspective view of the supporting device shown with respect to a motorcycling boot.

With reference to the above FIGURE, the numeral 1 designates a boot, particularly for motorcycling, which comprises a sole 2 onto which an upper 3 is stitched; the upper 3 affects both the region 4 of the malleoli and the region 5 of the tibia and calf of the motorcyclist.

The numeral 6 generally designates the supporting device, which is constituted by a semirigid body 7, preferably made of plastic material, which is arranged inside the boot 1 and is associated, preferably by stitching, with the upper 3 at the ankle region.

The semirigid body 7, which is formed monolithically, in fact has such a shape that it defines a band 8 which surrounds the lateral and rear regions of the foot, and its lower perimetric edge 9 rests approximately at the internal surface of the sole 2 or on an insole arranged thereat.

Said band 8 has a first terminal wing 10 and a second terminal wing 11 which are directed toward the tip 12 of the boot and preferably have different lengths; said length is greater at the first terminal wing 10, which is adjacent to the internal lateral part of the user's foot.

A pair of wings **14*a* and 14*b* is associated with the band 8 at the upper perimetric edge 13 in the malleolar region 4**; said wings preferably have a circular shape and are slightly concave with their concavity directed toward the malleolus.

Thus, said pair of wings **14*a* and 14*b*** on one hand protects said malleoli against accidental impacts and on the other hand, since said wings are rigidly coupled to the upper, they support the entire ankle region so as to prevent any yielding of the upper.

It has thus been observed that the invention has achieved the intended aim and objects, a supporting device having been obtained which, being formed monolithically and thus due to the band-like configuration with the presence of the pair of wings **14*a* and 14*b***, allows, once it is associated with the upper, to support and embrace the foot in an optimum manner independently of the shape which the boot can assume.

Secondarily, the foot is also protected against accidental impacts.

Optimum support in the ankle region thus allows to avoid sinks or splays of the upper and protects the ankle in an optimum manner, avoiding possible dislocations, torsions or flexions.

The material and the dimensions of the individual components of the invention may naturally be the most pertinent according to the specific requirements.

I claim:

1. In combination, a sports boot and a supporting device, said sports boot comprising a sole and an upper connected to said sole, said upper comprising: a medial malleolus supporting portion; a lateral malleolus supporting portion; a calf supporting portion; and a tibia supporting portion, and said upper extending upwardly from said sole for affecting malleoli, calf, and tibia regions of a user, and said upper extending upwardly from said sole past the tibia region and approximately up to a knee region of a user, said supporting device comprising:

a band element comprising a first inner lateral wing and a second outer lateral wing and a rear heel portion interconnected between said lateral wings; and a pair of malleolar wings comprising a first medial malleolar wing and a second lateral malleolar wing, said first medial malleolar wing being connected to and above said first inner lateral wing, said second lateral malleolar wing being connected to and above said second inner lateral wing;

said supporting device being attached to said upper in a manner such that said first medial malleolar wing is attached to said upper at said medial malleolus supporting portion thereof, and said second lateral malleolar wing is attached to said upper at said lateral malleolus supporting portion thereof, said band element being arranged below said malleolar wings and said first inner lateral wing and said second outer lateral wing extending from said rear heel portion of said band element towards a tip of said sports boot, said first medial malleolar wing of said supporting device having an upper perimetric edge arranged at said medial malleolus supporting portion and said second lateral malleolar wing of said supporting device having an upper perimetric edge arranged at said lateral malleolus supporting portion and thereby said calf supporting portion and said tibia supporting portion of said upper are flexible with respect to said medial and lateral malleolus supporting portions of the upper, and wherein said first medial malleolar wing and said second lateral malleolar wing have a circular shape and a concavity which is directed inwardly with respect to the sports boot.

2. The combination of claim 1, wherein said first inner lateral wing has a longer extension towards said tip of the sports boot than the extension of said second outer lateral wing.

3. The combination of claim 1, wherein said supporting device is made of plastic material.

4. The combination of claim 1, wherein said band of said supporting device has a lower perimetric edge which is arranged approximately at said sole of the sports boot.

5. A method of preventing deformation of an ankle region of a sports boot with an extended upper due to flexing of the extended upper with respect to the ankle region, in which the sports boot comprises a sole and an upper connected to said sole, and in which said upper comprises: a medial malleolus supporting portion; a lateral malleolus supporting portion; a calf supporting portion; and a tibia supporting portion, and said upper extends upwardly from said sole for affecting malleoli, calf, and tibia regions of a user, and said upper extends upwardly from said sole past the tibia region and approximately up to a knee region of a user, the method comprising the step of providing a supporting device, said supporting device comprising:

a band element comprising a first inner lateral wing and a second outer lateral wing and a rear heel portion interconnected between said lateral wings; and a pair of malleolar wings comprising a first medial malleolar wing and a second lateral malleolar wing, said first medial malleolar wing being connected to and above said first inner lateral wing, said second lateral malleolar wing being connected to and above said second inner lateral wing , said malleolar wings each having an upper perimetric edge;

the method further comprising the step of attaching said supporting device to said upper in a manner such that:

said first medial malleolar wing is attached to said upper at said medial malleolus supporting portion thereof;

said second lateral malleolar wing is attached to said upper at said lateral malleolus supporting portion thereof;

said band element is arranged below said malleolar wings and said first inner lateral wing;

said second outer lateral wing extends from said rear heel portion of said band element towards a tip of said sports boot; and the upper perimetric edge of said first medial malleolar wing is arranged at said medial malleolus supporting portion, and the upper perimetric edge of said second lateral malleolar wing is arranged at said lateral malleolus supporting portion;

thereby said calf supporting portion and said tibia supporting portion of said upper are sufficiently flexible with respect to said medial and lateral malleolus supporting portions of the upper while deformation at the ankle region of the sports boot is prevented, and wherein the step of providing a supporting device comprises providing said supporting device in which said first medial malleolar wing and said second lateral malleolar wing have a circular shape and a concavity which is directed inwardly with respect to the sports boot.

6. The method of claim 5, wherein the step of providing a supporting device comprises providing said supporting device in which said first inner lateral wing has a longer extension towards said tip of the sports boot than the extension of said second outer lateral wing.

7. The method of claim 5, wherein the step of providing a supporting device comprises providing said supporting device in which said supporting device is made of plastic material.

8. The method of claim 5, wherein the step of providing a supporting device comprises providing said supporting device in which said band of said supporting device has a lower perimetric edge, and wherein said step of attaching a supporting device to said upper comprises attaching said supporting device to said upper such that said lower perimetric edge is arranged approximately at said sole of the sports boot.

* * * * *